US005667296A

United States Patent [19]

Cheng et al.

[11] Patent Number: 5,667,296

[45] Date of Patent: Sep. 16, 1997

[54] WATER-TIGHT CHRISTMAS TREE LIGHT

[76] Inventors: You-Jen Cheng; Tzu-Ling Cheng, both of 2nd Fl., 18-9, Tienmu W. Road, Taipei City, Taiwan

[21] Appl. No.: 577,932

[22] Filed: Dec. 22, 1995

[51] Int. Cl.[6] ..... F21V 31/02

[52] U.S. Cl. ..... 362/267; 362/378; 439/280

[58] Field of Search ..... 439/271, 277, 439/280; 362/226, 249, 267, 390, 806, 376, 377, 378

[56] References Cited

U.S. PATENT DOCUMENTS

| | | | |
|---|---|---|---|
| 4,660,916 | 4/1987 | Williams, Jr. | 439/271 |
| 5,100,335 | 3/1992 | Yamamoto | 439/271 |
| 5,109,324 | 4/1992 | Ahroni | 362/249 |
| 5,350,315 | 9/1994 | Cheng et al. | 439/419 |
| 5,439,389 | 8/1995 | Cheng et al. | 439/419 |
| 5,474,467 | 12/1995 | Chen | 439/419 |

FOREIGN PATENT DOCUMENTS

| | | | |
|---|---|---|---|
| 119539 | 10/1918 | United Kingdom | 439/277 |
| 2253045 | 8/1992 | United Kingdom | 362/267 |

*Primary Examiner*—Alan Cariaso

*Attorney, Agent, or Firm*—Ladas & Parry

[57] ABSTRACT

A water-tight Christmas tree light which includes a lamp socket having an outward flange around one end thereof, an outer projecting wall raised around the periphery, and an outside annular groove around the periphery between the outward flange and the outer projecting wall; a lamp bulb fastened to the lamp socket; and a rubber sealing cap having a tapered, hollow, cylindrical cap body mounted on the lamp socket around the lamp bulb to seal the gap between the lamp socket and the lamp bulb, an inward top flange pressed on the periphery of the lamp bulb, a chamfered bottom edge forced into the outside annular groove of the lamp socket, an inside annular flange, an inside projecting wall disposed between the inside annular flange and the chamfered bottom edge, the inside annular flange stopped against and between the inside projecting wall and the periphery of the lamp bulb, and an inside annular groove defined within the cap body and the inside projecting wall to snugly receive the outer projecting wall of the lamp socket.

2 Claims, 3 Drawing Sheets

WATER-TIGHT CHRISTMAS TREE LIGHT

BACKGROUND OF THE INVENTION

The present invention relates to Christmas tree lights, and relates more particularly to a water-tight Christmas tree light which uses a rubber sealing cap to prohibit rain water from entering the inside of the lamp socket.

Various Christmas tree light sets and decorative strings have been disclosed, and have appeared on the market. In order to ensure a safety operation, various specifications including "UL", "CSA", etc., have been defined on the manufacturing of Christmas tree lights. However, conventional Christmas tree lights cannot effectively prohibit water from entering the inside of the lamp socket. Therefore, rain water tends to pass to the inside of the lamp socket of each Christmas tree light when a Christmas tree light set is installed outdoors. If a Christmas tree light is wetted, an electric shock may occur when the wetted Christmas tree light is touched by hand.

SUMMARY OF THE INVENTION

The present invention has been accomplished to provide a water-tight Christmas tree light which effectively prohibits water from entering the inside of the lamp socket. According to one embodiment of the present invention, the water-tight Christmas tree light comprises includes a lamp socket having an outward flange around one end thereof, an outer projecting wall raised around the periphery, and an outside annular groove around the periphery between the outward flange and the outer projecting wall; a lamp bulb fastened to the lamp socket; and a rubber sealing cap having a tapered, hollow, cylindrical cap body mounted on the lamp socket around the lamp bulb to seal the gap between the lamp socket and the lamp bulb, an inward top flange pressed on the periphery of the lamp bulb, a chamfered bottom edge forced into the outside annular groove of the lamp socket, an inside annular flange, an inside projecting wall disposed between the inside annular flange and the chamfered bottom edge, the inside annular flange being stopped against and between the inside projecting wall and the periphery of the lamp bulb, and an inside annular groove defined within the cap body and the inside projecting wall to snugly receive the outer projecting wall of the lamp socket. According to an alternate form of the present invention, the lamp socket is comprised of a lamp holder and a lamp base mounted within the lamp holder, wherein the outward flange of the lamp socket is made at one end of the lamp base, and the outer projecting wall and outside annular groove of the lamp socket is formed on the lamp holder.

DETAILED DESCRIPTION OF THE PREFERRED EMBODIMENTS

Figure 1:
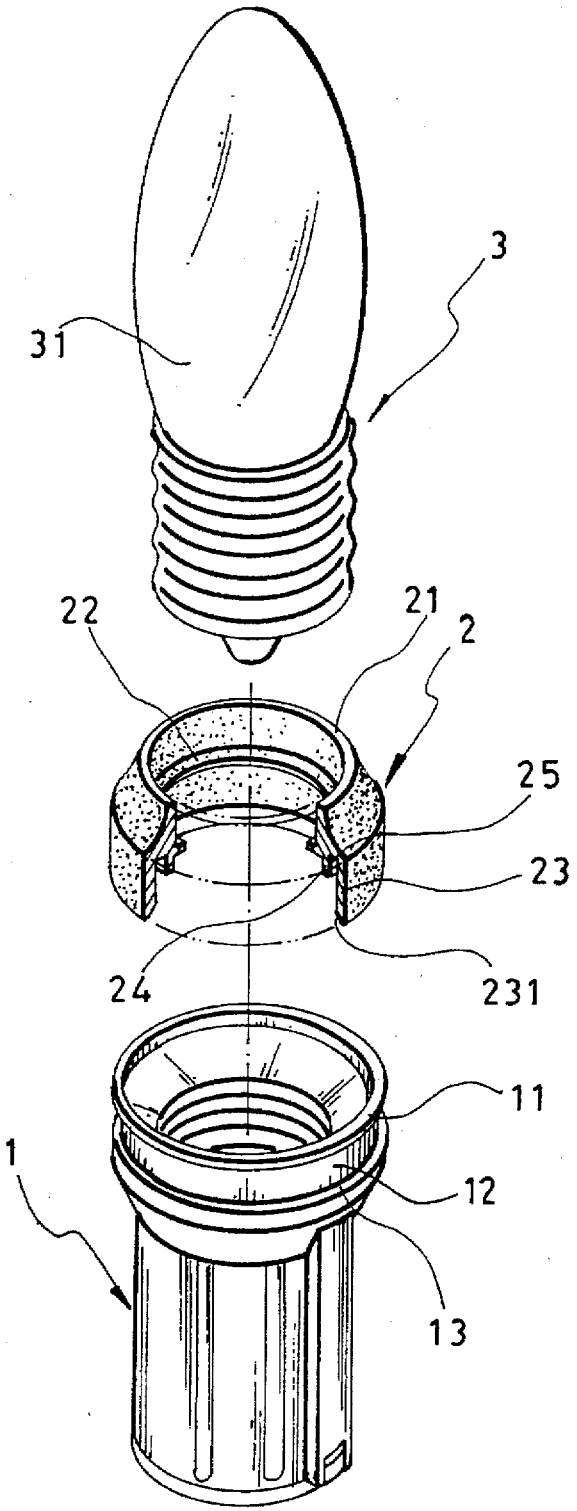
FIG. 1 is an exploded view of a water-tight Christmas tree light according to the present invention.
Figure 2:
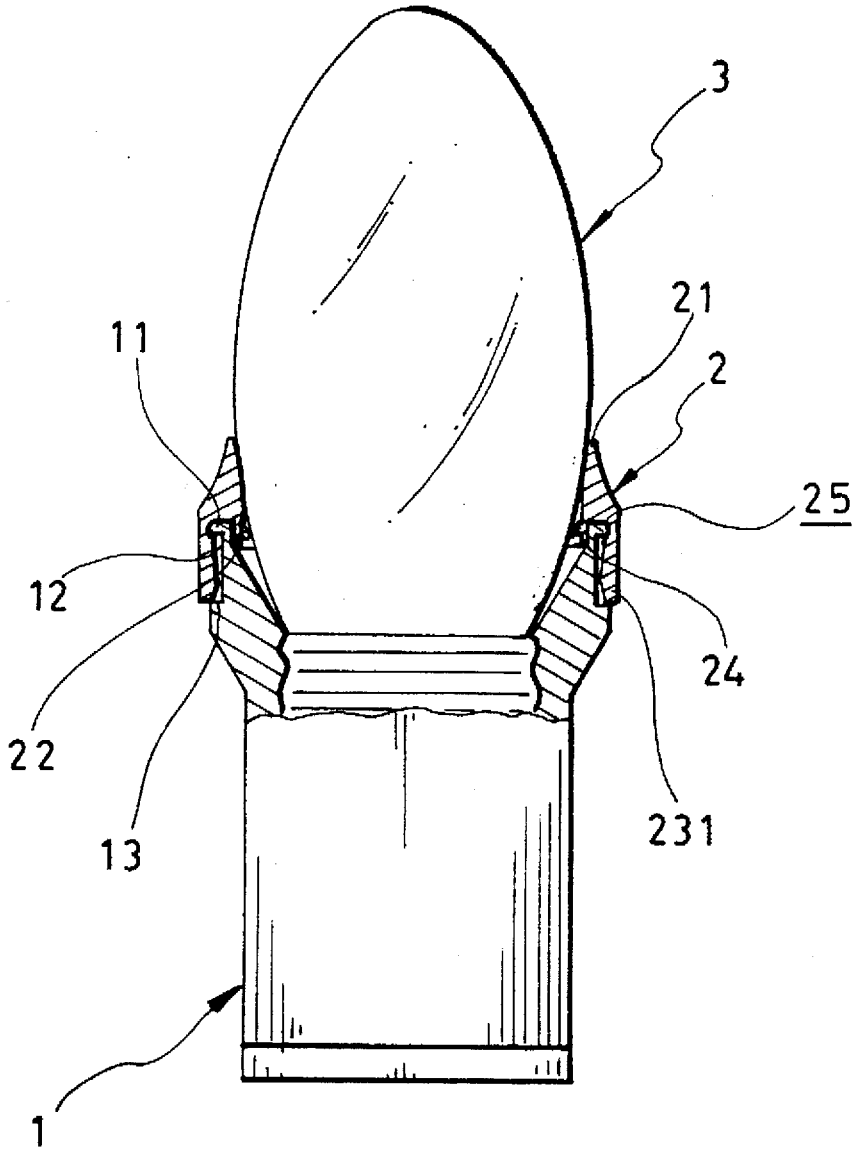
FIG. 2 is a plain view in section showing the water-tight Christmas tree light of FIG. 1 assembled.

Referring to FIGS. 1 and 2, a water-tight Christmas tree light in accordance with one embodiment of the present invention is shown comprised of a lamp socket 1, and a rubber sealing cap 2. The lamp socket 1 comprises an outward flange 11 around the mouth thereof, an outer projecting wall 13 raised around the periphery, and an outside annular groove 12 around the periphery between the outward flange 11 and the outer projecting wall 13. The rubber sealing cap 2 comprises a tapered, hollow, cylindrical cap body 23, an inward top flange 21 around the open top end of the cap body 23, a chamfered bottom edge 231 around the open bottom end of the cap body 23, an inside annular flange 22 raised from the inside of the cap body 23 at an elevation between the inward top flange 21 and the chamfered bottom edge 231, an inside projecting wall 24 disposed between the inside annular flange 22 and the chamfered bottom edge 231 and defining with the cap body 23 an inside annular groove 25. When the lamp bulb 3 is inserted through the rubber sealing cap 2 and threaded into the lamp socket 1, the rubber sealing cap 2 is fastened to the lamp socket 1 by: forcing the outward flange 11 of the lamp socket 1 into the inside annular groove 25 of the rubber sealing cap 2 and the chamfered bottom edge 231 of the rubber sealing cap 2 into the outside annular groove 12 of the lamp socket 1. When installed, the inward top flange 21 of the rubber sealing cap 2 is closely pressed on the bulb 31 of the lamp bulb 3, and the inside annular flange 22 is stopped against and between lamp bulb 31 and inside projecting wall 24 between the outward flange 11 and the outer projecting wall 13. Therefore, water is prohibited from entering the inside of the lamp socket through the gap between the lamp socket and the lamp bulb 3.

Figure 3:
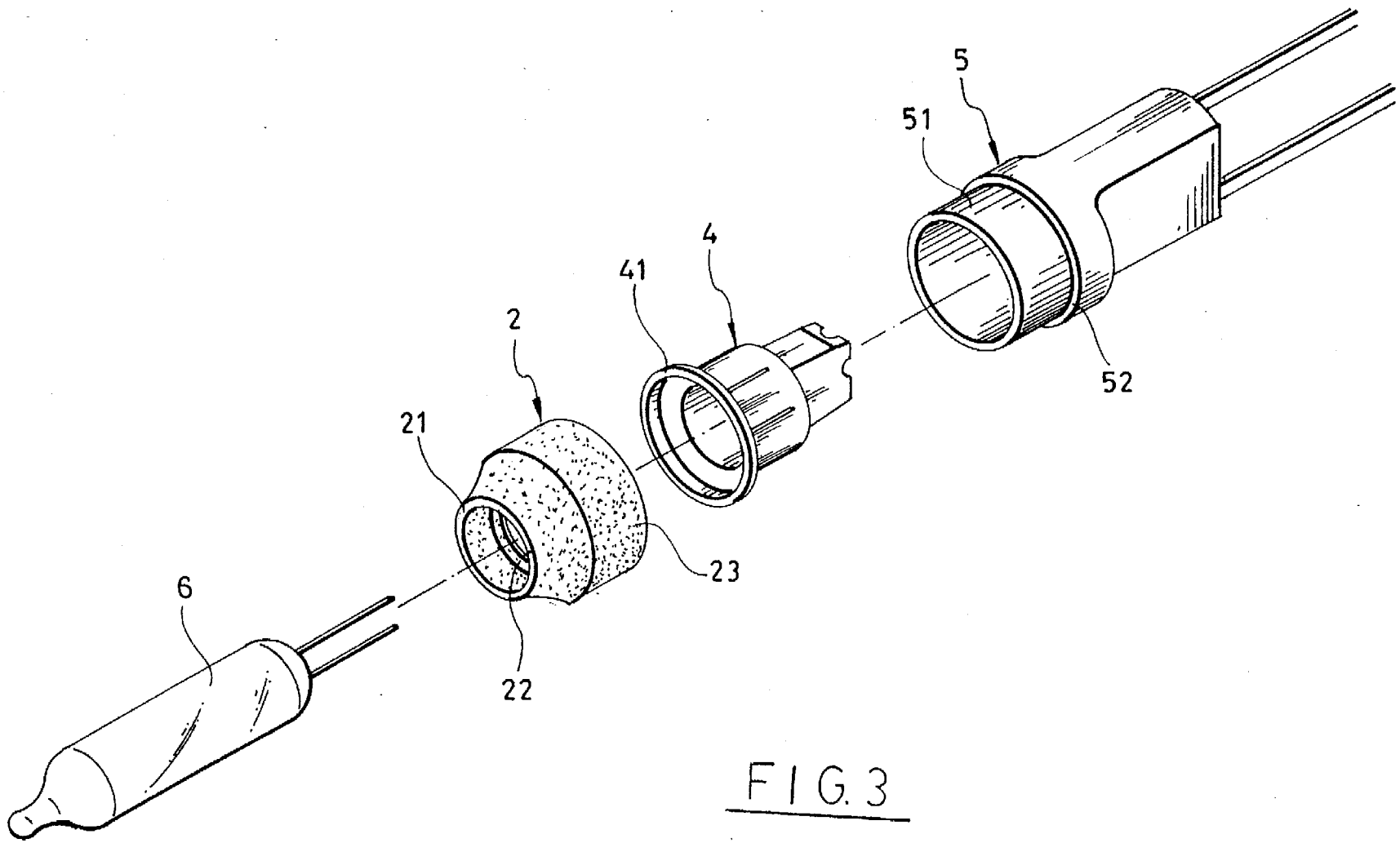
FIG. 3 is an exploded view of an alternate form of the present invention.

FIG. 3 shows a water-tight Christmas tree light according to a second embodiment of the present invention, which is comprised of a lamp holder 5 having an outer projecting wall 52 and an outside annular groove 51 defined within the outer projecting wall 52, a lamp holder having an outward flange 41 around the mouth, a rubber sealing cap 2, and a bulb 6. The rubber sealing cap 2 is of the same structure as shown in FIG. 1, having a tapered, hollow, cylindrical cap body 23, an inward top flange 21 around the open top end of the cap body 23, a chamfered bottom edge 231 (not shown) around the open bottom end of the cap body 23, an inside annular flange 22 raised from the inside of the cap body 23 at an elevation between the inward top flange 21 and the chamfered bottom edge 231, an inside projecting wall 24 (not shown) disposed between the inside annular flange 22 and the chamfered bottom edge 231 and defining with the cap body 23 an inside annular groove 25 (not shown). When assembled, the outward flange 41 of the lamp base 4 is forced into the inside annular groove 25 of the rubber sealing cap 2, the chamfered bottom edge 231 of the rubber sealing cap 2 is forced into the outside annular groove 51 of the lamp holder 5, and the inward flange 21 of the rubber sealing cap 2 is pressed on the periphery of the bulb 6 and on the inside projecting wall 24 (not shown).

We claim:

1. A water-tight Christmas tree light comprising:

a lamp socket having an outward flange around one end thereof, an outside annular surface defining a lamp socket periphery, an outer projecting wall raised around the lamp socket periphery, said outward flange and said outer projecting wall defining an outside annular groove therebetween;

a lamp bulb fastened to said lamp socket, said lamp bulb having a lamp bulb periphery; and a rubber sealing cap having a tapered, hollow, cylindrical cap body mounted on said lamp socket around said lamp bulb to seal a gap between said lamp socket and said lamp bulb, a first cap end and a second cap end opposite said first cap end, an inward top flange on said first cap end pressed on said lamp bulb periphery, a chamfered bottom edge on said second cap end forced into the outside annular groove of said lamp socket, an inside annular flange disposed between said inward top flange and said chamfered bottom edge, and an inside projecting wall disposed between said inside annular flange and said chamfered bottom edge, said inside annular flange being stopped against and between said inside projecting wall and said lamp socket periphery, and an inside annular groove defined within said cap body and said inside projecting wall to snugly receive the outer projecting wall of said lamp socket.

2. The water-tight Christmas tree light of claim 1 wherein said lamp socket is comprised of a lamp holder and a lamp base mounted within said lamp holder, the outward flange of said lamp socket being made at one end of said lamp base, the outer projecting wall and outside annular groove of said lamp socket being formed on said lamp holder.

* * * * *